US012035820B1

(12) United States Patent
Zhang

(10) Patent No.: US 12,035,820 B1
(45) Date of Patent: Jul. 16, 2024

(54) FOLDING CROSS BAR AND BABY CRIB

(71) Applicant: Xiamen Honor Industry and Trading Co., Ltd., Fujian (CN)

(72) Inventor: Jianyong Zhang, Fujian (CN)

(73) Assignee: Xiamen Honor Industry and Trading Co., Ltd., Fujian (CN)

( * ) Notice: Subject to any disclaimer, the term of this patent is extended or adjusted under 35 U.S.C. 154(b) by 0 days.

(21) Appl. No.: 18/581,957

(22) Filed: Feb. 20, 2024

Related U.S. Application Data

(63) Continuation of application No. 18/436,432, filed on Feb. 8, 2024, now abandoned.

(30) Foreign Application Priority Data

Jan. 31, 2024 (CN) ..... 202420239532.X

(51) Int. Cl.
*A47D 9/00* (2006.01)

(52) U.S. Cl.
CPC ..... *A47D 9/005* (2013.01)

(58) Field of Classification Search
CPC ..... A47D 9/00; A47D 9/005; A47D 9/008; A47D 9/012; A47D 11/007; A47D 13/06; A47D 13/061
See application file for complete search history.

(56) References Cited

U.S. PATENT DOCUMENTS

| | | | | |
|---|---|---|---|---|
| 11,864,667 | B1 * | 1/2024 | Zhang | A47D 9/005 |
| 2006/0021137 | A1 * | 2/2006 | Waldman | A47D 13/063 5/99.1 |
| 2009/0172879 | A1 * | 7/2009 | Hsu | A47D 13/063 5/99.1 |
| 2018/0008056 | A1 * | 1/2018 | Yang | F16B 7/14 |

* cited by examiner

*Primary Examiner* — David R Hare
*Assistant Examiner* — George Sun
(74) *Attorney, Agent, or Firm* — Cooper Legal Group, LLC

(57) ABSTRACT

The present application relates to a folding cross bar and a baby crib. The folding cross bar includes: a first bar body and a second bar body that are relatively foldable or unfoldable, where a first gear and a second gear are fixedly assembled at an opposite end of the first bar body and an opposite end of the second bar body respectively and meshed with each other; and a protective shell covering outer end surfaces of the first and second gears. The protective shell is arranged to seal the first and second gears, thereby preventing a child from contacting with the first and second gears to be pinched.

6 Claims, 7 Drawing Sheets

FOLDING CROSS BAR AND BABY CRIB

CROSS-REFERENCE TO RELATED APPLICATIONS

This application is a continuation of U.S. patent application Ser. No. 18/436,432, filed on Feb. 8, 2024, which claims priority to Chinese Patent Application 202420239532.X, filed on Jan. 31, 2024. U.S. patent application Ser. No. 18/436,432 and Chinese Patent Application 202420239532.X are incorporated herein by reference.

TECHNICAL FIELD

The present application relates to the technical field of manufacturing of furniture for children, and specifically to a folding cross bar.

BACKGROUND

The existing baby crib structurally includes a frame part and a cloth cover covering the frame part, where the frame part is further divided into a bottom frame and a side rail, and the side rail generally includes vertical bars vertically connected to the bottom frame and cross bars connected between the vertical bars, such that a closed rail structure is formed.

At present, many baby cribs are designed to be folding, thereby facilitating their storage and transportation. In such a folding baby crib, the cross bars are usually designed to be folding, each group of the folding cross bars includes two bar bodies and a joint arranged between the two bar bodies, and the two bar bodies are both pivotable relative to the joint so as to implement relative unfolding or folding of the two bar bodies.

During unfolding or folding of the folding baby crib, it is best for the two bar bodies in a group of the folding cross bars to rotate simultaneously, such that one of the bar bodies can be prevented from being inclined or deviated, and the folding or unfolding of the folding baby crib can be smoothly carried out. In view of this, gears are mounted at opposite ends of two bar bodies in some existing folding cross bar structures, and simultaneous rotation of the two bar bodies is ensured through gear meshing.

However, the meshing between the gears will bring a lot of potential safety hazards, and especially for children, there is a greater risk of being pinched by the gears. Moreover, when the gears are meshed, the cloth cover is easily wound into them to be deformed and damaged.

SUMMARY

In view of the above problems, the present application proposes a folding cross bar having an optimized structure, and further proposes a baby crib with the folding cross bar based on the folding cross bar.

The present application is implemented by adopting the following solution:

The present application proposes a folding cross bar, applied to furniture for children, and including: a first bar body, a second bar body, and a joint connected between the first bar body and the second bar body, where the first bar body and the second bar body are both rotatably connected to the joint so that they can pivot to fold or unfold relatively, a first gear is fixedly assembled at one end of the first bar body that is relatively close to the second bar body, a second gear is fixedly assembled at one end of the second bar body that is relatively close to the first bar body, and the first gear is meshed with the second gear to implement simultaneous rotation of the first bar body and the second bar body; and a protective shell, where the protective shell is fixedly connected to the joint in a manner of covering at least an outer end surface of the first gear and an outer end surface of the second gear.

In one embodiment, preferably, the folding cross bar further includes a constraint system, where the constraint system limits axial ends of the first gear and the second gear, such that the first gear and the second gear are incapable of being axially staggered to be demeshed.

In one embodiment, preferably, the constraint system is fixedly arranged on the protective shell.

In one embodiment, preferably, considering one first gear and one second gear in mesh as one pair of gears, there are two pairs of gears arranged at intervals in an axial direction and arranged on two sides of the joint, respectively; the protective shell includes a first half protective shell and a second half protective shell arranged on the two sides of the joint and correspondingly covering the two pairs of gears, respectively; a constraint part is fixedly arranged on an inner side of each of the first half protective shell and the second half protective shell; and the constraint part on the first half protective shell and the constraint part on the second half protective shell together form the constraint system.

In one embodiment, preferably, a projection of the constraint part in the axial direction of the first gear extends vertically and passes through a pitch point of the first gear and the second gear in mesh.

In one embodiment, preferably, the constraint part is a strip-shaped bulge integrally formed on the inner side of the first half protective shell or the second half protective shell.

In one embodiment, preferably, the first half protective shell and the second half protective shell are arranged in a manner of being capable of being connected in the axial direction of the first gear to form the protective shell.

In one embodiment, preferably, a connector is fixedly mounted at the one end of the first bar body that is relatively close to the second bar body, and a connector is fixedly mounted at the one end of the second bar body that is relatively close to the first bar body; the first gear or the second gear is fixedly mounted on the connector; a protruding part is fixedly arranged on the connector; and the protruding part is implemented to protrude towards the joint in an unfolded state of the folding cross bar, such that the protruding part is capable of abutting against the joint upwards during relative unfolding of the first bar body and the second bar body.

In one embodiment, preferably, the folding cross bar further includes a third bar body and a fourth bar body, where the third bar body in the unfolded state of the folding cross bar is transversely arranged above the first bar body in parallel, and the fourth bar body in the unfolded state of the folding cross bar is transversely arranged above the second bar body in parallel; the first gear is relatively located on a left side of the second gear, the second gear is relatively located on a right side of the first gear, a first slide groove and a second slide groove in left-right mirror symmetry with the first slide groove are provided in the joint and extend transversely, and the third bar body and the fourth bar body are connected into the first slide groove and the second slide groove by pins, respectively; and a third slide groove and a fourth slide groove are further provided in the joint, the third slide groove includes an inclined section extending upwards obliquely and a locking section connected to an upper end of the inclined section and extending transversely, the fourth slide groove and the third slide groove are in left-right mirror symmetry, the third bar body is further connected into the third slide groove by a pin, and the fourth bar body is further connected into the fourth slide groove by a pin.

Based on the above folding cross bar, the present application further proposes a crib, including a folding frame part, where the frame part includes the folding cross bar as described above.

The present application has the following beneficial effects: according to the present application, the protective shell is arranged to cover the first gear and the second gear, such that the first gear and the second gear are sealed, thereby preventing a child from contacting with the first gear and the second gear, improving the safety performance, and preventing a cloth cover from being wound into the first gear and the second gear to be damaged. The constraint system is further arranged on the protective shell to prevent the first gear and the second gear from being axially staggered to be demeshed, thereby improving the reliability.

DESCRIPTION OF EMBODIMENTS

To further describe embodiments, the present application provides accompanying drawings. These drawings constitute a part of content of the present application and are mainly used to illustrate the embodiments and to explain the operating principles of the embodiments in conjunction with the related description of the specification. With reference to the content, those of ordinary skill in the art can understand other possible embodiments and advantages of the present application. Components in figures are not drawn to scale, and similar component signs are often used to refer to similar components.

The present application is now further described in conjunction with the accompanying drawings and specific embodiments.

Figure 1:
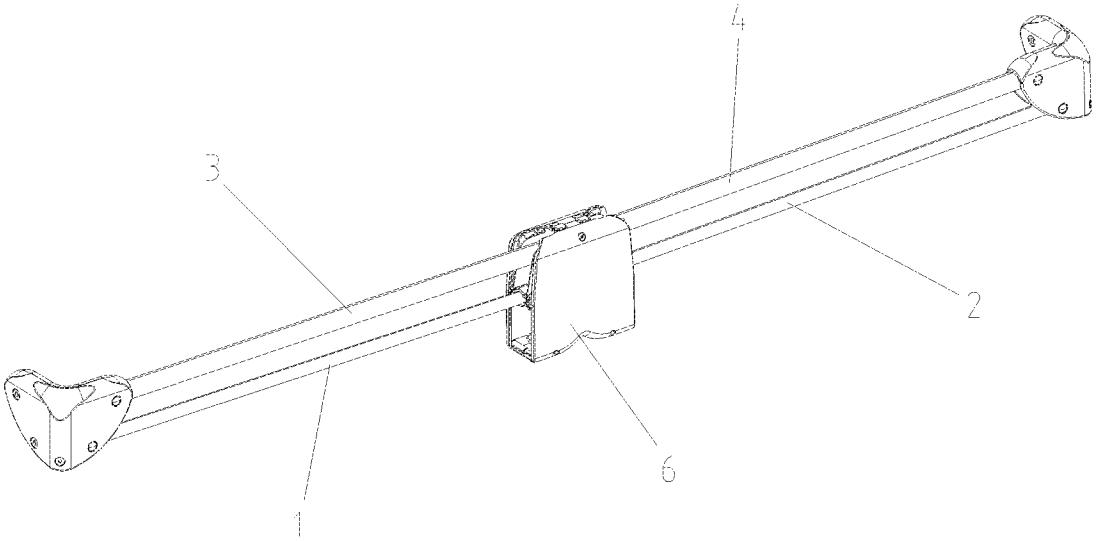
FIG. 1 is a schematic three-dimensional view of a folding cross bar in an embodiment.
Figure 2:
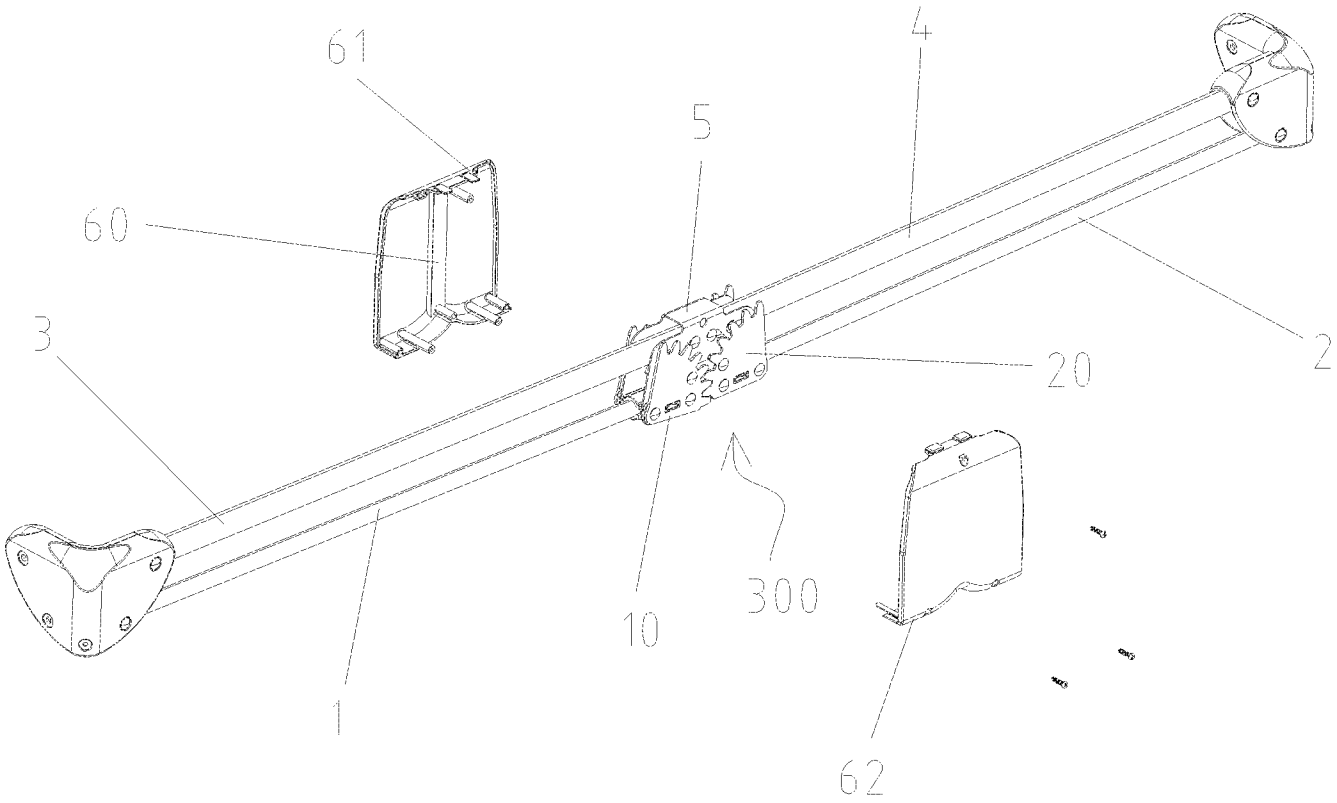
FIG. 2 is an exploded view of a preliminary structure of a folding cross bar in an embodiment.
Figure 3:
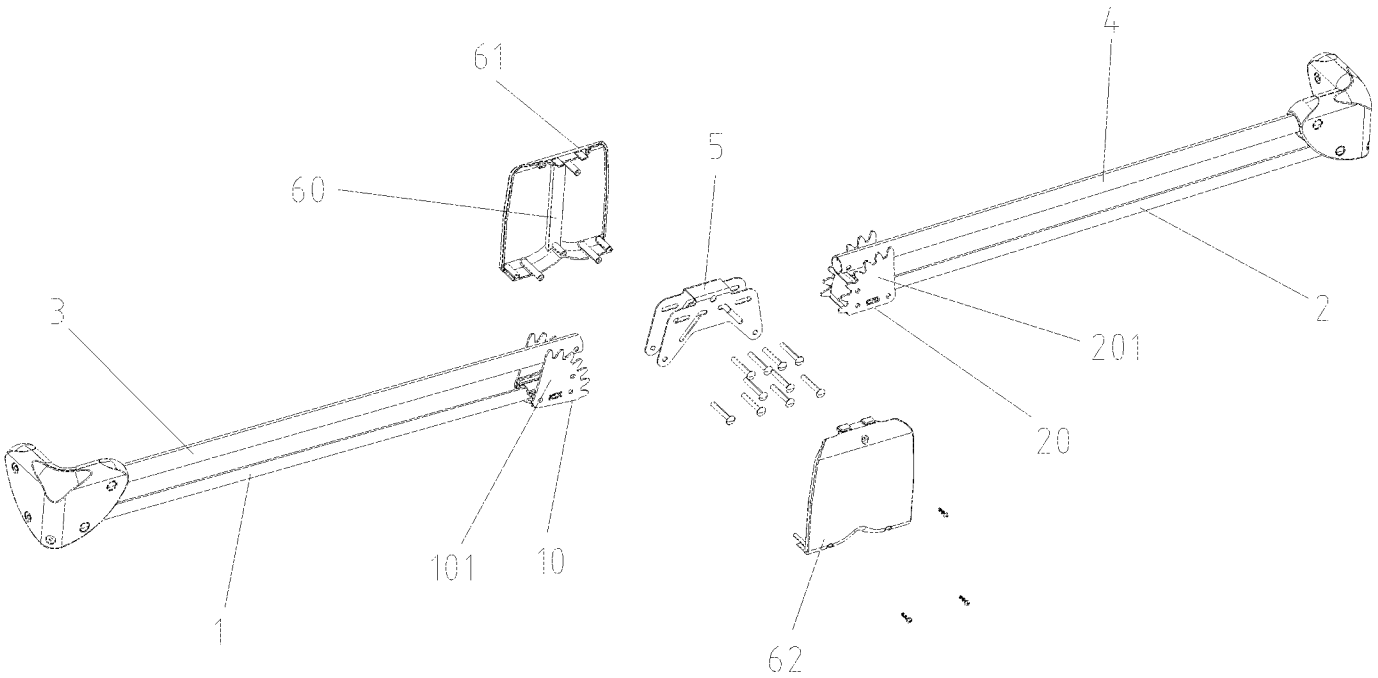
FIG. 3 is an exploded view of a further structure of a folding cross bar in an embodiment.

Referring to FIGS. 1 to 3, as a preferred embodiment of the present application, there is provided a folding cross bar, which is applied to furniture for children and specifically can be applied to a baby crib or a children's playpen. The folding cross bar includes a first bar body 1, a second bar body 2, and a joint 5 connected between the first bar body 1 and the second bar body 2, where the first bar body 1 and the second bar body 2 are both rotatably connected to the joint 5 so that they can pivot to fold or unfold relatively. For the convenience of description, an orientation of the folding cross bar in a horizontally unfolded state is used for description in this embodiment.

A first gear 10 is fixedly assembled at one end of the first bar body 1 that is relatively close to the second bar body 2, a second gear 20 is fixedly assembled at one end of the second bar body 2 that is relatively close to the first bar body 1, and the first gear 10 is meshed with the second gear 20 to implement simultaneous rotation of the first bar body 1 and the second bar body 2. Because a rotation angle of the first bar body 1 and the second bar body 2 in unfolded and folded states is less than or equal to 90°, the first gear 10 and the second gear 20 are implemented as incomplete sector gears in this embodiment. This can save materials for manufacturing the first gear 10 and the second gear 20, and reduce the unnecessary number of teeth. The first gear 10 and the second gear 20 are both of a sheet-like structure to reduce their space occupation.

Figure 5:
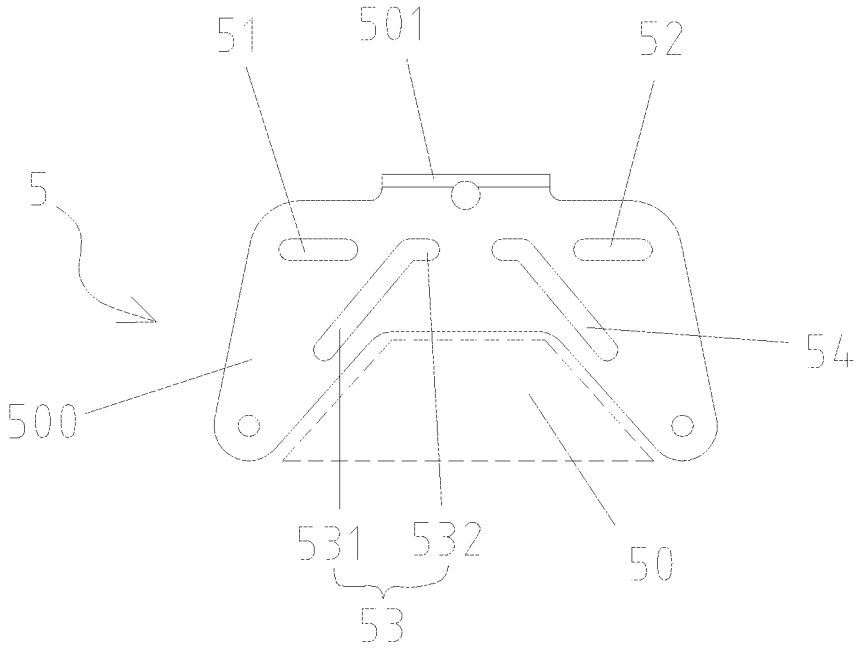
FIG. 5 is a front view of a joint in an embodiment.

As shown in FIG. 3 and FIG. 5, the joint 5 is formed by fixedly connecting two spaced joint sheets 500 through a connecting section 501 in this embodiment. In order to fully utilize a mounting space, an interlayer space between the two joint sheets 500 is usually set to accommodate an unfolding locking mechanism of the folding cross bar. The unfolding locking mechanism is a mechanism for locking the folding cross bar in the unfolded state, and is commonly used in this field. The unfolding locking mechanism in this embodiment will be described below. In order to avoid the interference between the first gear 10 or the second gear 20 and the unfolding locking mechanism, as shown in FIG. 2, the first gear 10 and the second gear 20 are both arranged on an outer side of the joint 5 in this embodiment.

As shown in FIGS. 1 to 3, the protective shell 6 is fixedly connected to the joint 5 and covers at least an outer end surface 101 of the first gear 10 and an outer end surface 201 of the second gear 20. The outer end surfaces 101 and 201 more specifically refer to end surfaces of the first gear 10 and the second gear 20 that face the outside of the folding cross bar in the folding cross bar as a whole. In this embodiment, the outer end surfaces 101 and 201 are end surfaces of the first gear 10 and the second gear 20 that are away from the joint 5. In this embodiment, the protective shell 6 is arranged to cover the first gear 10 and the second gear 20, such that the first gear 10 and the second gear 20 are sealed, thereby preventing a child from contacting with the first gear 10 and the second gear 20, improving the safety performance, and preventing a cloth cover from being wound into the first gear 10 and the second gear 20 to be damaged.

In this embodiment, a lower end of the protective shell 6 is closed, such that it is possible to further prevent the child from stretching the hands into the protective shell 6 and to prevent the cloth cover from being wound into the first gear 10 and the second gear 20. Specifically, in this embodiment, the protective shell 6 and the joint 5 are fixed through threaded connection, which makes the protective shell 6 and the joint 5 detachable, thereby facilitating the repair and maintenance of the folding cross bar.

Considering one first gear 10 and one second gear 20 in mesh as one pair of gears 300, as shown in FIG. 3, there are two pairs of gears 300 in total in this embodiment. The two pairs of gears 300 are arranged at intervals in an axial direction and arranged on two sides of the joint 5, respectively, such that forces on the first bar body 1 and the second bar body 2 are more balanced. As shown in FIG. 2 and FIG. 3, the protective shell 6 includes a first half protective shell 61 and a second half protective shell 62 arranged on the two sides of the joint 5 and correspondingly covering the two pairs of gears 300, respectively. In this embodiment, the first half protective shell 61 and the second half protective shell 62 are connected in the axial direction of the first gear 10 to form the protective shell 6. The first half protective shell 61 and the second half protective shell 62 may be connected using a buckle structure and/or a threaded connection structure to facilitate the mounting and dismounting of the first half protective shell 61 and the second half protective shell 62. In other embodiments, the protective shell 6 may be provided with an upper half part and a lower half part, and the upper half part and the lower half part are connected in an up-down direction to form the protective shell 6. However, in practical application, because the cloth cover is partially located below the folding cross bar, the first half protective shell 61 and the second half protective shell 62 connected in that manner in this embodiment will not interfere with the cloth cover, thereby better facilitating the mounting and dismounting of the protective shell 6.

Figure 7:
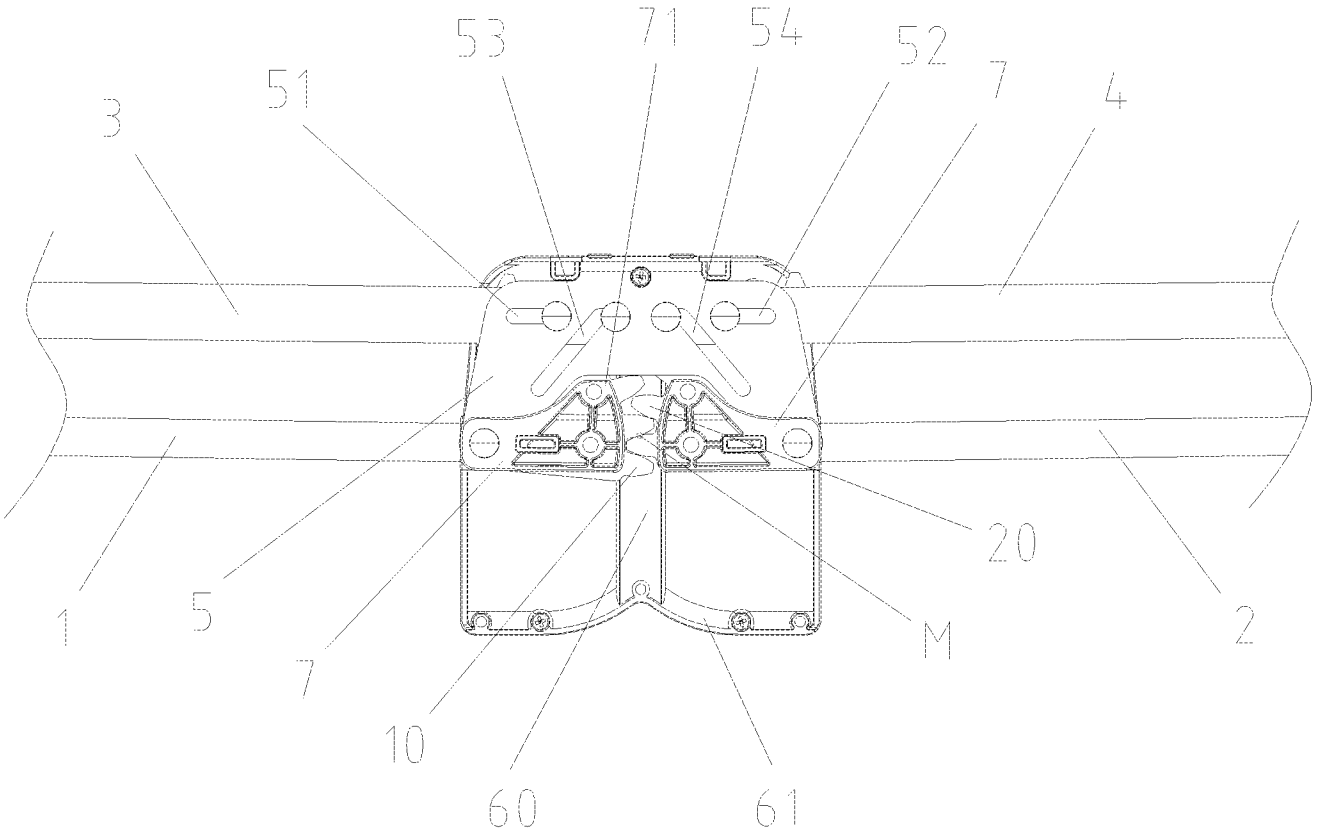
FIG. 7 is a front view of a folding cross bar after a second half protective shell is hidden in an embodiment.
Figure 8:
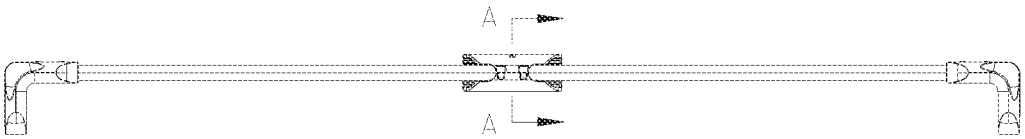
FIG. 8 is a top view of a folding cross bar in an embodiment.
Figure 9:
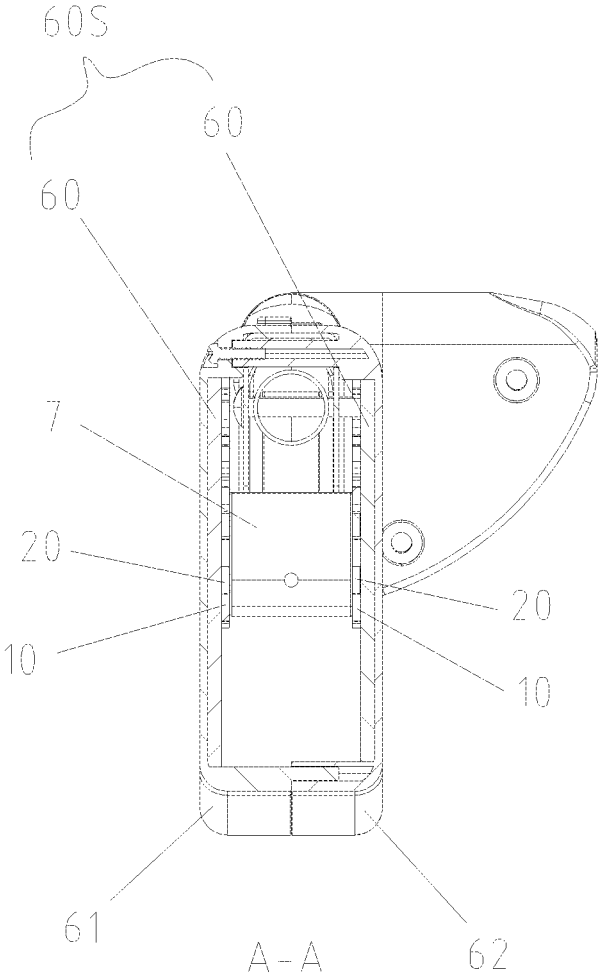
FIG. 9 is a sectional view of A-A in FIG. 8.

In the two pairs of gears 300, the two first gears 10 are both fixedly connected to the first bar body 1, which can be regarded as a relatively fixed whole; and the two second gears 20 are both fixedly connected to the second bar body 2, which can be regarded as a relatively fixed whole. Referring to FIGS. 2, 7, and 9, a constraint part 60 (a constraint part 60 on the second half protective shell 62 cannot be seen due to an angle in FIG. 2, and reference can be made to FIG. 9) is fixedly arranged on an inner side of each of the first half protective shell 61 and the second half protective shell 62; and the two constraint parts 60 are correspondingly located at outer ends of the two pairs of gears 300 in the axial direction, respectively. Each constraint part 60 can limit axial outward movement of the corresponding first gear 10 and second gear 20, such that the two constraint parts 60 form one constraint system 60S. The constraint system 60S limits two ends of each of the two pairs of gears 300 in the axial direction to prevent the first gear 10 and the second gear 20 from being staggered in the axial direction to be demeshed. Considering the miniaturization of shape and the reduction of weight, in this embodiment, the first gear 10 and the second gear 20 are both sheet-like and have very small tooth widths, which causes the first gear 10 and the second gear 20 to be easily staggered to be demeshed during frequent folding and unfolding of the folding cross bar. After the constraint system 60S is arranged, the positions of the first gear 10 and the second gear 20 can be constrained by the constraint system 60S to improve the meshing reliability of the first gear 10 and the second gear 20.

In other embodiments, the constraint system 60S may be arranged at other positions, for example, the constraint system 60S may be arranged on the joint 5 in the same case where two pairs of gears 300 are arranged. If there is only a pair of gears 300, a constraint part can be arranged on each of the joint 5 and the protective shell 6 to form the constraint system. With the structure of this embodiment, the protective shell 6 arranged outside can be exactly used as a carrier to arrange the constraint system 60S without changing the structure of the joint 5, because the joint 5 is generally made of metal and the protective shell 6 is made of plastics. The constraint system 60S is fixedly arranged on the protective shell 6 to better facilitate its manufacturing. In this embodiment, the constraint part 60 is injection-molded on the protective shell 6.

The constraint part 60 is of a strip-shaped bulge structure in this embodiment. As shown in FIG. 7, a projection of the constraint part 60 in the axial direction of the first gear 10 extends vertically and passes through a pitch point of the first gear 10 and the second gear 20, such that only one constraint part 60 can limit the first gear 10 and the second gear 20 simultaneously. Certainly, corresponding to a pair of gears 300, two constraint parts 60 may be arranged to limit the first gear 10 and the second gear 20, respectively.

Figure 4:
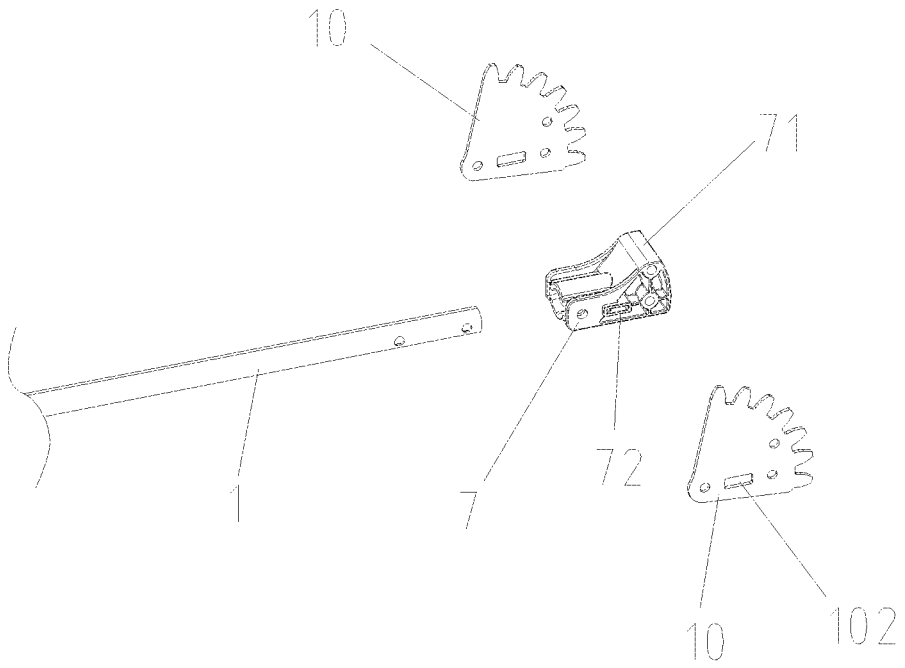
FIG. 4 is a schematic exploded view of a first bar body, a connector, and first gears in an embodiment.

As shown in FIGS. 4 to 7, a connector 7 is fixedly mounted at the one end of the first bar body 1 that is relatively close to the second bar body 2, and a connector 7 is fixedly mounted at the one end of the second bar body 2 that is relatively close to the first bar body 1; and the first gear 10 or the second gear 20 is fixedly mounted on the connector 7. Insertion bulges 72 are arranged on the connector 7. As shown in FIG. 4, an insertion hole 102 is provided in the first gear 10, each insertion bulge 72 is cooperatively inserted into the insertion hole 102 to implement fixed assembly of the first gear 10 and the connector 7, and the first gear 10 and the connector 7 may further be connected by a pin to improve the reliability of connection. The fixed connection way for the connector 7 on the second gear 20 and the second bar body 2 is the same.

Figure 6:
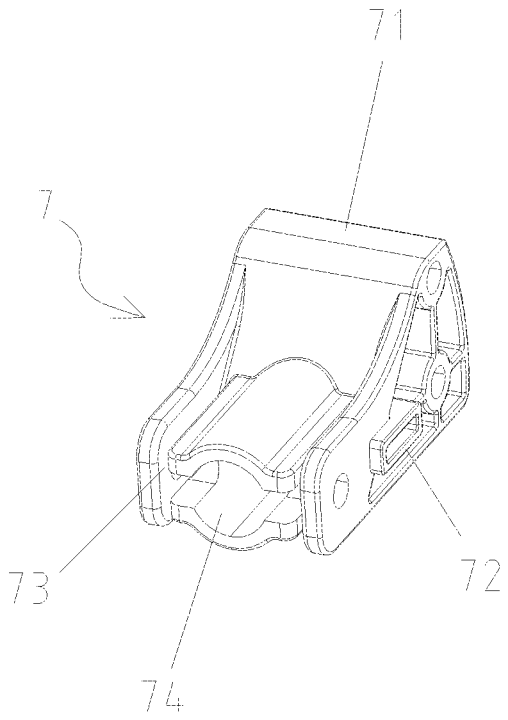
FIG. 6 is a schematic three-dimensional view of a connector in an embodiment.

Each joint sheet 500 is in an inverted U shape with a downward opening, and the opening in a lower end thereof forms an accommodating area 50. As shown in FIG. 6, an insertion hole 74 and an insertion gap 73 are further provided in the connector 7, where the insertion hole 74 is configured to implement fixed insertion between the connector 7 and the first bar body 1 or the second bar body 2, and the insertion gap 73 is inserted into the lower end of the joint sheet 500 to implement rotatable connection between the connector 7 and the joint sheet 500 and to allow a free end of the connector 7 to extend into the accommodating area 50. A protruding part 71 is fixedly arranged at the free end of the connector 7 and implemented to protrude towards the joint 5 in the unfolded state of the folding cross bar.

Referring to FIG. 1 cooperatively, the folding cross bar further includes a third bar body 3 and a fourth bar body 4, where the third bar body 3 in the unfolded state of the folding cross bar is transversely arranged above the first bar body 1 in parallel, and the fourth bar body 4 in the unfolded state of the folding cross bar is transversely arranged above the second bar body 2 in parallel. One end of the third bar body 3 that gets away from the fourth bar body 4 and one end of the first bar body 1 that gets away from the second bar body 2 are hinged on a same object. In this embodiment, the object is a corner connector for connecting the folding cross bar to a vertical bar of the crib. One end of the fourth bar body 4 that gets away from the third bar body 3 and one end of the second bar body 2 that gets away from the first bar body 1 are hinged on a same object. In this embodiment, the object is a corner connector for connecting the folding cross bar to a vertical bar of the crib. It is defined that the first gear 10 is relatively located on a left side of the second gear 20, and the second gear 20 is relatively located on a right side of the first gear 10. Continuing referring to FIG. 5 and FIG. 7, a first slide groove 51 and a second slide groove 52 in left-right mirror symmetry with the first slide groove 51 are provided in the joint 5 and extend transversely, and the third bar body 3 and the fourth bar body 4 are connected into the first slide groove 51 and the second slide groove 52 by pins, respectively; and a third slide groove 53 and a fourth slide groove 54 are further provided in the joint 5, the third slide groove 53 includes an inclined section 531 extending upwards obliquely and a locking section 532 connected to an upper end of the inclined section 531 and extending transversely, the fourth slide groove 54 and the third slide groove 53 are in left-right mirror symmetry, the third bar body 3 is further connected into the third slide groove 53 by a pin, and the fourth bar body 4 is further connected into the fourth slide groove 54 by a pin. During rotation of the folding cross bar from the folded state to the unfolded state, the connecting pin for the third bar body 3 and the third slide groove 53 first slides in the inclined section 531 from bottom to top and stops until the connecting pin slides to a corner where the inclined section 531 is connected to the locking section 532. In this case, the protruding part 71 of the connector 7 exactly abuts against the joint 5 upwards, such that the joint 5 moves up, and the connecting pin for the third bar body 3 and the third slide groove 53 can slide into the locking section 532. After the folding cross bar is unfolded, the connecting pin and the locking section 532 implement the unfolding locking of the folding cross bar. The cooperation between the fourth bar body 4 and the fourth slide groove 54 is the same as that between the third bar body 3 and the third slide groove 53. The third bar body 3, the fourth bar body 4, the first slide groove 51, the second slide groove 52, the third slide groove 53, the fourth slide groove 54, and the pins arranged in the slide grooves together constitute the unfolding locking mechanism of the folding cross bar. The design of the accommodating area 50 allows the first bar body 1 and the second bar body 2 to be unfolded horizontally. When the protruding part 71 of the connector 7 abuts against the joint 5, swing of the first bar body 1 and the second bar body 2 is used to implement the unfolding locking. The structure is simple and reliable.

While the present application has been specifically shown and described with reference to the preferred embodiments, it is to be understood by those skilled in the art that various changes in form and details may be made to the present application without departing from the spirit and scope of the present application defined by the appended claims, and all fall within the scope of protection of the present application.

The invention claimed is:

1. A folding cross bar, applied to furniture, and comprising: a first bar body, a second bar body, and a joint connected between the first bar body and the second bar body, wherein the first bar body and the second bar body are both rotatably connected to the joint so that the first bar body and the second bar body are configured to pivot to fold or unfold relatively, two first gears are fixedly disposed at one end of the first bar body facing the second bar body, two second gears are fixedly assembled at one end of the second bar body facing the first bar body, and the two first-gear is gears are meshed with the two second gears to implement simultaneous rotation of the first bar body and the second bar body;

wherein the folding cross bar further comprises a protective shell fixedly connected to the joint to cover at least an outer end surface of the two first gears and an outer end surface of the two second gears;

the folding cross bar further comprises a constraint system, wherein the constraint system limits axial ends of the two first gears and the two second gears, such that the two first gears and the two second gears are incapable of being axially staggered to be demeshed;

the constraint system is fixedly arranged on the protective shell;

the two first gears and the two second gears are arranged into two pairs, each of the two pairs comprising one of the two first gears and one of the two second gears, the two pairs are arranged at intervals in an axial direction and arranged on two sides of the joint, respectively; the protective shell comprises a first half protective shell and a second half protective shell arranged on the two sides of the joint and correspondingly covering the two pairs, respectively; a constraint part is fixedly arranged on an inner side of each of the first half protective shell and the second half protective shell; and the constraint part on the first half protective shell and the constraint part on the second half protective shell together form the constraint system; and a projection of the constraint part in the axial direction of the two first gears extends vertically and passes through a pitch point of the two first gears and the two second gears.

2. The folding cross bar according to claim 1, wherein the constraint part is a strip-shaped bulge integrally formed on the inner side of the first half protective shell or the second half protective shell.

3. The folding cross bar according to claim 1, wherein the first half protective shell and the second half protective shell are arranged to be connected in the axial direction of the two first gears to form the protective shell.

4. A baby crib, comprising a folding frame part, wherein the folding frame part comprises the folding cross bar according to claim 1.

5. A folding cross bar, applied to furniture, and comprising: a first bar body, a second bar body, a joint connected between the first bar body and the second bar body, and a protective shell, wherein the first bar body and the second bar body are both rotatably connected to the joint so that the first bar body and the second bar body are configured to pivot to fold or unfold relatively, a first gear is fixedly disposed at one end of the first bar body facing the second bar body, a second gear is fixedly assembled at one end of the second bar body facing the first bar body, and the first gear is meshed with the second gear to implement simultaneous rotation of the first bar body and the second bar body;

the protective shell is fixedly connected to the joint to cover at least an outer end surface of the first gear and an outer end surface of the second gear;

a connector is fixedly mounted at the one end of the first bar body facing the second bar body, and a second connector is fixedly mounted at the one end of the second bar body facing the first bar body; the first gear is fixedly mounted on the connector and the second gear is fixedly mounted on the second connector; a protruding part is fixedly arranged on each of the connector and the second connector; and the protruding part is implemented to protrude towards the joint in an unfolded state of the folding cross bar, such that the protruding part is configured to abut against the joint upwards during relative unfolding of the first bar body and the second bar body.

6. The folding cross bar according to claim 5, further comprising a third bar body and a fourth bar body, wherein the third bar body in the unfolded state of the folding cross bar is transversely arranged above the first bar body in parallel, and the fourth bar body in the unfolded state of the folding cross bar is transversely arranged above the second bar body in parallel; the first gear is relatively located on a left side of the second gear, the second gear is relatively located on a right side of the first gear, a first slide groove and a second slide groove in left-right mirror symmetry with the first slide groove are provided in the joint and extend transversely, and the third bar body and the fourth bar body are connected into the first slide groove and the second slide groove by first pins, respectively; and a third slide groove and a fourth slide groove are further provided in the joint, the third slide groove comprises an inclined section extending upwards obliquely and a locking section connected to an upper end of the inclined section and extending transversely, the fourth slide groove and the third slide groove are in left-right mirror symmetry, the third bar body is further connected into the third slide groove by a second pin, and the fourth bar body is further connected into the fourth slide groove by a third pin.

* * * * *